United States Patent [19]

Mantyla

[11] Patent Number: 4,709,832

[45] Date of Patent: Dec. 1, 1987

[54] FLEXIBLE CLOSURE FOR RESEALING CONTAINERS

[76] Inventor: Jim Mantyla, 12 Westhill Road, Guelph, Ontario, N1H 7T6, Canada

[21] Appl. No.: 882,559

[22] Filed: Jul. 7, 1986

[30] Foreign Application Priority Data

Nov. 12, 1985 [CA] Canada ..... 494996

[51] Int. Cl.[4] ..... B65D 41/16; B65D 41/18

[52] U.S. Cl. ..... 220/306; 220/281

[58] Field of Search ..... 220/281, 306; 215/317, 215/301, 224

[56] References Cited

U.S. PATENT DOCUMENTS 4,180,178 12/1979 Turner ..... 220/281

*Primary Examiner*—George T. Hall

*Attorney, Agent, or Firm*—Rogers, Bereskin & Parr

[57] ABSTRACT

A flexible closure is disclosed for resealing opened circular-topped containers of carbonated fluids. The flexible cover has a top portion, and a sealing skirt, the sealing skirt being rigidly attached to the top portion. The top portion has a central relieved portion which is deflectable in response to pressure from carbon dioxide gas escaping from the fluid. The sealing skirt extends from the top portion and is adapted to receive the circular top of the container in sealing relationship. The sealing skirt may be rotated either radially towards the container, by deflection of the central relieved portion away from the contrainer, or radially away from the container by deflection of the central relieved portion towards the container. The flexible closure is therefore easily removed or secured to the opened container, and yet maintains a seal as a result of pressure from carbon dioxide gas escaping the fluid.

12 Claims, 3 Drawing Figures

FLEXIBLE CLOSURE FOR RESEALING CONTAINERS

This invention relates broadly to flexible covers for resealing opened standard containers, such as cans, of carbonated fluid having a rolled rim around the top of the can, and a sidewall extending down below the rolled rim. In particular this invention relates to a flexible cover comprising a top portion, a downwardly extending sealing skirt extending from the top portion, and means for sealing the sealing skirt against the container in response to deflection of the top portion away from the container under pressure from carbon dioxide gas escaping from the carbonated fluid and for releasing the cover from the container in response to deflections of the top portion towards the container.

It is popular now, and has been for some time to sell drinks for human consumption which have had carbon dioxide gas dissolved into them such as soft drinks and beer. However, the gas will escape if the fluid is not kept sealed under pressure. The amount of gas that remains dissolved depends upon factors such as temperature, and the pressure keeping the gas in solution.

The makers and sellers of carbonated fluids have attempted to develop optimum sized portions, in standardized containers, like cans, but this "one size fits all" approach is not always appropriate. For example, a standard sized soft drink can is often too large for young children who may be unable to consume the entire contents in one sitting. Also, when preparing mixed drinks in which alcohol is added to a non-alcoholic carbonated mix, it is often only necessary to use a portion of the non-alcoholic carbonated mix at any one time. The rest of the mix may not be required. Therefore, in certain cases it will not be possible to finish the carbonated drink right away after opening it. However, if no pressure is provided to keep the carbon dioxide gas in solution, then the gas will escape out of solution. If the gas does escape, the drink is said to have gone "flat"; it has lost its ability to create a pleasant tingling sensation in the mouth. Also, because the carbon dioxide affects the flavour, the drink will be less palatable. For example, a soft drink which has gone flat tends to taste overly sweet. Invariably a drink which has gone flat will be thrown out, rather than being consumed, which is an obvious waste.

In the prior art there are several examples of attempts to provide closure members for resealing opened containers containing carbonated fluid. For example Winnick,in U.S. Pat. No. 3,604,588 entitled CAN COVER AND SEALER, discloses an example of an attempt to provide a sealing cover for cans. The sealing cover of this invention comprises a member having a spaced apart skirt portion to define a circumferentially extending channel with means for frictionally receiving therein the projecting lip portion of a can in sealing relationship therebetween. According to the invention of Winnick, escaping gas will seal the inner lip of the skirt against the projecting lip portion of the can. However, because the carbon dioxide gas escapes very slowly, unless the inner lip of the skirt is already sealed to the edge of the can, no sealing pressure will develop, because the gas will escape to the spaced between the inner and outer lips. Further, as the pressure increases, the outer lip will be forced away from the container, resulting in the loss of the seal.

Another example of an attempt to provide a closure for containers is U.S. Pat. No. 3,247,994 issued to Fuglsang-Madsen. This invention relates to a closure for standard containers, especially bottles, having an outwardly projecting annular convex container bead. More particularly, this invention relates to a plastic cap comprising a top-plate, an unsplit skirt portion extending downwardly from said top plate, and below said skirt portion an internally disposed clamping bead. The clamping bead is intended to engage the lower side of the container bead, and a seal is formed by tension created in the material of the cap by stretching the cap to fit over the bottle top and container bead.

Such a tension fit is not appropriate where it is desired to make the cap or closure member easy to apply to the container and easy to remove therefrom. Also, such a tension fit will not work where the surface area of the cap is large, and the container bead is small, as in the case of standard cans, because the upward force generated by the escaping gas will be too large.

According to the present invention, a flexible closure for resealing an opened container of carbonated fluid is disclosed. The container has a standard shape with a circular top. The circular top has an opening, a vertically extending rim around the upper outer edge, and a sidewall extending down from the vertically extending rim. The flexible closure comprises a top portion deflectable away from the circular top in response to pressure from carbon dioxide gas escaping from the carbonated fluid and through the opening, a sealing skirt extending down from the top portion for receiving the circular top of the container in sealing relationship and for sealing against the vertically extending rim or the indentation. The flexible closure further comprises means, responsive to deflection of the top portion, for sealing the skirt to the circular top of the container.

The invention will now be more fully described with reference to the accompanying illustrations, illustrating a preferred embodiment in which.

Figure 1:
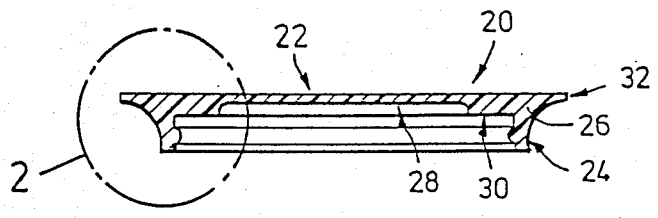
FIG. 1 is a sectional view of a flexible closure according to the present invention.

With reference to FIG. 1, a flexible closure is generally denoted by reference 20, and comprises a top portion 22, a downwardly extending sealing skirt 24, and rigid connection 26 connecting top portion 22 with sealing skirt 24.

Top portion 22 is further comprised of a central relieved portion 28, an annular portion 30 extending radially therefrom, and a flange 32 extending radially from annular position 30. According to the present invention, central relieved portion 28 is more flexible than annular portion 30. It will be appreciated that in the preferred embodiment, the flexible closure is composed of one homogeneous material, and central portion 28 is made more flexible than annular portion 30 by making central portion 28 thinner than annular portion 30. However, the additional flexibility could also be provided by making central portion 28 from a more flexible material than annular portion 30. In this case, the thickness of central portion 28 could be equal to, or even greater than the thickness of annular portion 30.

Figure 2:
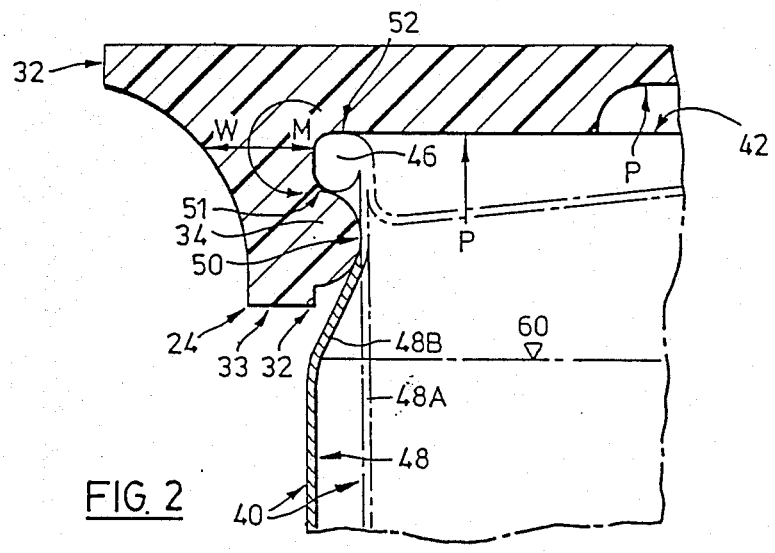
FIG. 2 is an enlargement of circle 2 of FIG. 1 including a container shown in ghost outlines.

Sealing skirt 24 extends downwardly from top portion 22, at annular portion 30. With reference to FIG. 2, sealing skirt 24 has guide means 32 and sealing bead 34. Guide means 32 may take the form of a relieved rim as shown in FIG. 2 and the purpose of guide means 32 is set out more particularly below.

As depicted in FIG. 2, sealing skirt 24 also has a width, depicted by the double ended arrow W, which is sufficient, having regard to the material composition of cover 20, to form a rigid connection between annular portion 30 and sealing skirt 24. Also, although sealing skirt 24 tapers towards the bottom 33, sealing skirt 24 is sufficiently wide, having regard to the material composition of cover 20, that it is stiff and resists lateral deflection.

Also depicted in FIG. 2, in ghost outlines, is a standard can 40, with a circular top indicated at 42. The top 42 has an opening 44 which is depicted in the cut away view of FIG. 3. Again with reference to FIG. 2, a vertically extending rim 46 is located on the upper outer edge of top 42. Side wall 48 of can 40 may be either straight, as indicated at 48A, or it may have an indentation, as indicated at 48B.

Flexible closure 20 may be easily applied to a standardized container such as a can 40. First, can 40 is placed under the closure 20. Then guide means 32 is used to locate rim 46 within sealing skirt 24. As can be seen from FIG. 2, rim 46 will be stopped by sealing bead 34 from entering further into cover 20, because sealing skirt 24 is stiff and resists lateral deformation. However, applying a downward force at the center of cover 20, thereby deflecting central relieved portion 28 towards can 40, will cause sealing skirt 24 to rotate about the rigid connection 26 between annular portion 30 and sealing skirt 24. As a result sealing bead 34 is moved radially away from vertical rim 46, and can 40 slides easily into flexible closure 20. Removing the downward force from the center of cover 20 allows central relieved portion 28 to return to its normal undeflected position. As central relieved portion 28 returns to its normal undeflected position, sealing skirt 24 rotates around the rigid connection 26 between sealing skirt 24 and annular portion 30 and moves radially towards can 40. The distance between the top of sealing bead 34 and the bottom of annular portion 30 is designed to snugly accommodate vertical rim 46. Further, sealing bead 34 is adapted to snugly engage side wall 48 of container 40 below vertically extending rim 46.

Flexible cover 20 seals against container 40 at three points, depicted as 50, 51 and 52 respectively. First sealing point 50 is located between sealing bead 34 and sidewall 48. Second sealing point 51 is located between sealing bead 34 and vertically extending rim 46. Third sealing point 52 is located between annular portion 30 and vertical rim 46.

Carbonated fluid is indicated by shading lines and has a surface level indicated at 60. Carbon dioxide gas escapes from carbonated fluid through surface 60 and as indicated by arrows P creates pressure under flexible cover 20. Under the influence of this pressure flexible cover 20 bows outwardly at central relieved region 28, which creates a bending moment about the rigid connection 26 between downwardly extending skirt 24 and annular portion 30 as indicated by curved arrow M. The moment indicated by arrow M tends to force sealing bead 34 even more tightly against sidewall 48 and vertically extending rim 46 at first sealing point 50 and second sealing point 51 respectively. Also, although annular portion 30 may tend to lift away from vertically extending rim 46 at third sealing point 52 flexible cover 20 will tend to be even more tightly sealed by reason of the addition sealing force on the sealing bead 34, at first sealing point 50 and second sealing point 51. Some of the dissolved carbon dioxide gas will escape from the carbonated fluid through surface 60 to create pressure between the surface 60 and flexible cover 20, but the amount of gas that can escape will be limited, because as more gas escapes, and the pressure increases, central relieved portion 28 deflects away from container 40 more, rotating sealing skirt 24 further towards container 40 and pressing sealing bead 34 more tightly to container 40 at sealing points 50 and 51. In this manner flexible cover 20 seals more tightly as the pressure increases, until the pressure between the fluid surface 60 and the underside of flexible cover 20 is sufficient to prevent any further gas from escaping from the carbonated fluid. Therefore, the carbonation can be maintained for extended periods after the container has been opened without the carbonated beverage going flat.

Figure 3:
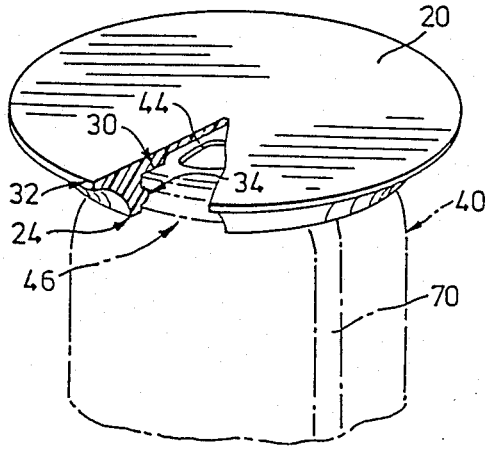
FIG. 3 is a perspective view with a cut-away portion showing the flexible closure in use on a container which is shown in ghost outlines.

With reference to FIG. 3, although flexible cover 20 is depicted as being circular, the shape of the radially extending flange 32 does not have to be circular. However, the downwardly extending sealing skirt 24 must be adapted to receive the upper rim 46 of container 40 and therefore will normally be circular. Radially extending flange 32 facilitates the easy removal of flexible cover 20 from container 40. By applying a downward force on central relieved portion 28 and simultaneously lifting up under radially extending flange 32, the flexible cover is easily removed. In this situation, deflecting the central relieved portion 28 towards the container 40 will cause sealing skirt to rotate about the rigid connection 26 between sealing skirt 24 and annular portion 30. This in turn causes sealing bead 34 to move radially away from container 40 allowing container 40 to be easily removed from the flexible closure 20.

It should also be noted that some standard containers have a seam 70 which run vertically up the side of the container as indicated in FIG. 3. Because flexible closure 20 has three sealiug points, namely 50, 51, and 52, a seal will be maintained between surface 60 and flexible closure 20 even around the seam 70.

I claim:

1. A flexible closure for sealing a container of carbonated fluid having a circular top, said circular top having an opening, a vertically extending rim, and a sidewall extending below said vertically extending rim, said flexible closure comprising:

a top portion deflectable away from said circular top in response to pressure from carbon dioxide gas escaping from said carbonated fluid through said opening; and a rigid sealing skirt extending from said top portion for receiving said circular top in sealing relationship and for sealing against said vertically extending rim and said sidewall;

said sealing skirt being rigidly attached to said top portion to render the top portion and the sealing skirt substantially immovable relative to one another, the closure being sufficiently flexible to enable rotation of said sealing skirt towards said sidewall in response to deflection of said top portion outwardly, and for rotation of said sealing skirt away from said sidewall in response to deflection of said top portion inmwardly.

2. The flexible closure of claim 1 wherein said sealing skirt further comprises:

a means for guiding said circular top into said sealing skirt; and a sealing bead extending from said sealing skirt towards said container for sealing against said sidewall or said vertically extending rim.

3. A flexible closure for sealing a container of carbonated fluid having a circular top, said circular top having an opening, a vertically extending rim, and a sidewall extending below said vertically extending rim, said flexible closure comprising:

a-top portion having;

a central portion for deflecting outwardly or inwardly from said circular top, an annular portion extending radially from said central portion, and a flange extending radially from said annular portion;

a sealing skirt extending down from said annular portion for receiving said circular top in sealing relationship and having a means for guiding said circular top into said sealing skirt, and a sealing bead extending from said sealing skirt towards said container for sealing against said sidewall and said vertically extending rim; and a rigid attachment between said sealing skirt and said annular portion for rotating said sealing skirt towards said container in response to deflection of said top portion away from said circular top, and for rotation of said sealing skirt outwardly from said container in response to deflection of said top portion inwardly towards said circular top.

4. The flexible cover of claim 3, wherein said flexible cover is made from moldable plastic.

5. The flexible closure of claim 1, wherein sid central portion is thinner than said annular portion.

6. The flexible closure of claim 1 wherein said sealing skirt has a gradually tapering thickness whereby said base of said sealing skirt joining said top portion is thicker than a downwardly extending end of said sealing skirt.

7. The flexible closure of claim 1 further comprising an outwardly extending flange extending from said annular portion, said flange being joined to said sealing skirt by a smoothly curved surface, said flange gradually tapering outwardly and said skirt gradually tapering downwardly.

8. The flexible closure of claim 1 wherein said closure is circular when viewed from above or below.

9. The flexible closure of claim 3, wherein said central portion is thinner than annular portion.

10. The flexible closure of claim 3 wherein said sealing skirt has a gradually tapering thickness whereby said base of said sealing skirt joining said top portion is thicker than a downwardly extending end of said sealing skirt.

11. The flexible closure of claim 3 wherein flange is joined to said sealing skirt by a smoothly curved surface, said flange gradually tapering outwardly and said sealing skirt gradually tapering downwardly.

12. The flexible closure of claim 3 wherein said closure is circular when viewed from above or below.

* * * * *